US005743663A

United States Patent [19]

Imai

[11] Patent Number: 5,743,663

[45] Date of Patent: Apr. 28, 1998

[54] RECORD MEDIUM FEEDING IN A COLOR THERMAL PRINTER

[75] Inventor: Ryo Imai, Saitama, Japan

[73] Assignee: Fuji Photo Film Co., Ltd., Kanagawa, Japan

[21] Appl. No.: 690,317

[22] Filed: Jul. 25, 1996

[30] Foreign Application Priority Data

Jul. 28, 1995 [JP] Japan ..... 7-193734
Jul. 5, 1996 [JP] Japan ..... 8-176251

[51] Int. Cl.[6] ..... B41J 2/315

[52] U.S. Cl. ..... 400/120.04; 400/636; 347/174; 347/219

[58] Field of Search ..... 400/120.02, 120.03, 400/120.04, 120.18, 120 MP, 120 MC, 120 MT, 621, 636; 347/172, 174, 175, 176, 177, 178, 212, 155, 156, 219; 101/424.1; 355/282, 285, 286, 287, 288, 326 R

[56] References Cited

U.S. PATENT DOCUMENTS 5,463,417 10/1995 Yamakawa ..... 347/212
5,486,856 1/1996 Katsuma et al. ..... 347/212

FOREIGN PATENT DOCUMENTS 61-031270 2/1986 Japan ..... 400/120 MP
5-251160 10/1993 Japan ..... 347/212
5-254161 10/1993 Japan ..... 347/212
6-047933 2/1994 Japan ..... 347/212
6-79893 3/1994 Japan .
6-246988 9/1994 Japan ..... 400/621

*Primary Examiner*—David A. Wiecking

[57] ABSTRACT

In the pull-out direction of continuous color thermosensitive recording paper, a cutter, a transport roller pair, a thermal head, and a fixing unit are disposed in this order. The transport roller pair alternately performs pull-out and pull-back of the continuous color thermosensitive recording paper a plurality of times. During the three pull-back operations of the continuous color thermosensitive recording paper, a yellow image, a magenta image, and a cyan image are sequentially recorded with the thermal head. Shortly before the magenta and cyan images are recorded, the yellow and magenta images are fixed with the fixing unit, when the recording area moves past the fixing unit. After the full-color image is recorded, the continuous color thermosensitive recording paper is again pulled out and when the preset cut position reaches a cutter, the cutter cuts the paper into a print sheet.

28 Claims, 7 Drawing Sheets

RECORD MEDIUM FEEDING IN A COLOR THERMAL PRINTER

BACKGROUND OF THE INVENTION

1. Field of the Invention

The present invention relates to a color thermal printer, and more particularly to a color thermal printer for printing a full-color image on a roll of continuous recording paper and cutting a recorded portion into one print sheet.

2. Description of the Background Art

A thermal transfer system and a color direct thermal print system (thermosensitive coloring print system) are used for color thermal printers. In the thermal transfer system, an ink ribbon or an ink film is placed on a recording sheet and heated from the back with a thermal head to transfer ink of the ink ribbon or ink film to the recording sheet. The thermal transfer system includes a wax transfer type which melts ink and a sublimination type which transfers ink dye. The sublimination type is suitable for recording a half-tone image because the amount of transferred ink changes with heat energy.

In the color direct thermal print system, a sheet of color thermosensitive recording paper is used which develops color having a density corresponding to heat energy supplied from a thermal head. This color thermosensitive recording sheet has cyan, magenta, and yellow thermosensitive coloring layers overlaid on a support. The uppermost yellow thermosensitive coloring layer has the highest heat sensitivity, and the lowermost cyan thermosensitive coloring layer has the lowest heat sensitivity. Each thermosensitive coloring layer is sequentially recorded starting from the uppermost layer. After the yellow thermosensitive coloring layer is recorded, it is fixed by near-ultraviolet rays of 420 nm in order not to develop color at undeveloped component areas while the magenta thermosensitive coloring layer is recorded. Similarly, after the magenta thermosensitive coloring layer is recorded, it is fixed by ultraviolet rays of 365 nm.

Japanese Patent Laid-open Publication No. 6-79893 describes a color direct thermal printer (color thermosensitive printer) which uses a roll of continuous color thermosensitive recording paper and cuts a recorded portion into a print sheet. With this color thermosensitive printer, a continuous color thermosensitive recording sheet is pulled out of the recording paper roll and fed to a platen roller. At the outer peripheral area of this platen roller, a pinch roller and a thermal head are disposed. The continuous color thermosensitive recording paper moves around the platen roller half a rotation to be bent in generally a U-character shape, and thereafter it is supplied to a fixing unit. This fixing unit has a yellow ultraviolet lamp for radiating near-ultraviolet rays of 420 nm and a magenta ultraviolet lamp for radiating ultraviolet rays of 365 nm. A cutter, which is disposed downstream of the fixing unit and in front of a paper discharge port, cuts the recorded portion of the continuous color thermosensitive recording paper into one separate sheet.

In this color thermosensitive printer, after the continuous color thermosensitive recording paper is pulled out of the recording paper roll by a predetermined amount, the platen roller and recording paper roll are rotated in the reverse direction to perform a first pull-back operation. During this first pull-back operation, a yellow image is recorded one line after another on the continuous color thermosensitive recording paper in a recording area, while depressing and heating the continuous color thermosensitive recording paper with the thermal head.

The continuous color thermosensitive recording paper is again pulled out of the recording paper roll and the yellow thermosensitive coloring layer is fixed by the turned-on yellow ultraviolet lamp. During a second pull-back operation of the continuous color thermosensitive recording paper, a magenta image is recorded by using the thermal head. Thereafter, the continuous color thermosensitive recording paper is again pulled out of the recording paper roll and the magenta thermosensitive coloring layer is fixed by the turned-on magenta ultraviolet lamp. During a third pull-back operation, a cyan image is recorded one line after another on the cyan thermosensitive coloring layer. After recording the cyan image, the continuous color thermosensitive recording paper is again pulled out of the recording paper roll and the recorded area is cut into a print sheet with a cutter.

Recently, a high image quality like a silver salt photograph is desired even for a color thermal printer. In order to record a high quality image, it is necessary to ensure a high precision paper feed. However, in a platen drive system in which an image is printed while continuous color thermosensitive recording paper nipped with the thermal head and platen is fed, the continuous color thermosensitive recording paper may slip between the thermal head and platen, and a high precision paper feed is difficult.

Particularly in the case of color thermosensitive printing, the heat energy generated by a thermal head differs depending upon the color of an image to be recorded. Specifically, the friction coefficient between the thermal head and continuous color thermosensitive recording paper changes with color. For example, the friction resistance is large while a yellow image is recorded, whereas it is small while a cyan image is recorded. A difference of friction resistance causes a shift of color registration.

SUMMARY OF THE INVENTION

It is an object of the present invention to provide a color thermal printer capable of feeding paper at high precision.

It is another object of the present invention to provide a color thermal printer capable of preventing generation of a shift of color registration.

In order to achieve the above and other objects, the color thermal printer of this invention is provided with a transport roller pair which nips continuous recording paper, and alternately performs pull-out and pull-back of the continuous recording paper. A thermal head is disposed at the downstream side of the transport roller pair and records an image of a first color in the recording area of the continuous recording paper during the first pull-back, records an image of a second color during the second pull-back, and records an image of a third color during the third pull-back. A cutter is disposed at the downstream side of the recording paper roll to cut the continuous recording paper into a print sheet.

In an embodiment of this invention, as the continuous recording paper, continuous color thermosensitive recording paper is used. This continuous color thermosensitive recording paper has a cyan thermosensitive coloring layer, a magenta thermosensitive coloring layer, and a yellow thermosensitive coloring layer sequentially overlaid on a support. After each color image is recorded, the yellow thermosensitive coloring layer and magenta thermosensitive coloring layer are respectively fixed by ultraviolet rays radiated from a fixing unit. This fixing unit is disposed at the downstream side of the recording paper roll. Ultraviolet rays are applied only to the recorded area of the continuous color thermosensitive recording paper, and a shutter is mounted on the fixing unit to avoid exposure variation of ultraviolet rays.

According to this embodiment since the continuous recording paper is transported by the transport roller pair, a variation of the feed amount of the continuous recording paper can be reduced and the paper feed can be performed with high precision. Therefore, a shift of color registration to be caused by a variation of the feed amount can be eliminated. Since printing is performed while the continuous recording paper is pulled back, a paper margin can be reduced considerably and waste of the continuous recording paper can be eliminated.

Since the cutter for cutting the recording paper into a print sheet is disposed between the paper feed roller pair and transport roller pair, the same transport sequence of the continuous color thermosensitive recording paper can be used for all color prints. After the completion of printing, the tip of the continuous color thermosensitive recording paper is at the position upstream of a paper outlet port. Therefore, without providing a specific light shielding structure at the paper discharge port, the tip area of the continuous color thermosensitive recording paper is not exposed by ultraviolet rays radiated from a fluorescent lamp or the like as a room illumination.

Ultraviolet rays in the first wavelength range are applied during the second pull-back for recording a magenta image and also during the second pull-out for recording the magenta image. Therefore, the exposure amount of ultraviolet rays can be reduced correspondingly and the lamp can be reduced in size.

In this embodiment, continuous color thermosensitive recording paper is pulled out until the recording area enters the ultraviolet exposure area of the fixing unit and the preset cut position reaches an end of the ultraviolet exposure area. Therefore, the margin of the white frame can be reduced and waste of the continuous color thermosensitive recording paper is eliminated.

The paper feed roller pair is disposed at the upstream side of the transport roller pair. Therefore, the continuous color thermosensitive recording paper can be pulled out smoothly from the recording paper roll. Since a loop forming unit is disposed between the recording roll and transport roller pair, it is not necessary to wind back the recording paper roll.

The yellow and magenta ultraviolet lamps are made in a single unit and this unit is rotated. Therefore, the ultraviolet exposure area can be made narrow so that the feed amount of the continuous color thermosensitive recording paper can be reduced and the printer system can be made compact.

BRIEF DESCRIPTION OF THE DRAWINGS

The above and other objects and advantages of the invention will become apparent from the following detailed description of the preferred embodiments when read in conjunction with the accompanying drawings, wherein.

DETAILED DESCRIPTION OF THE PREFERRED EMBODIMENTS

Figure 1:
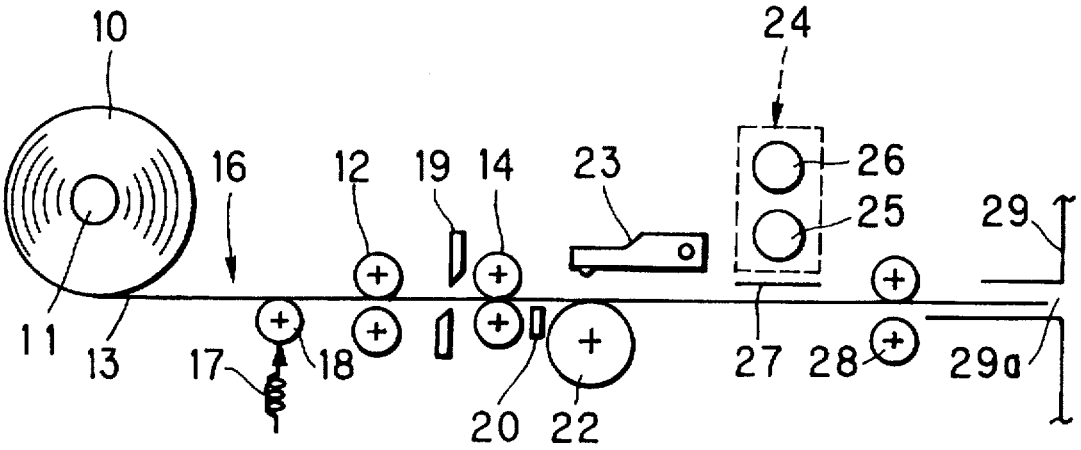
FIG. 1 is a schematic diagram showing a color thermosensitive printer of the invention under the condition that continuous color thermosensitive recording paper has been pulled out.
Figure 2:
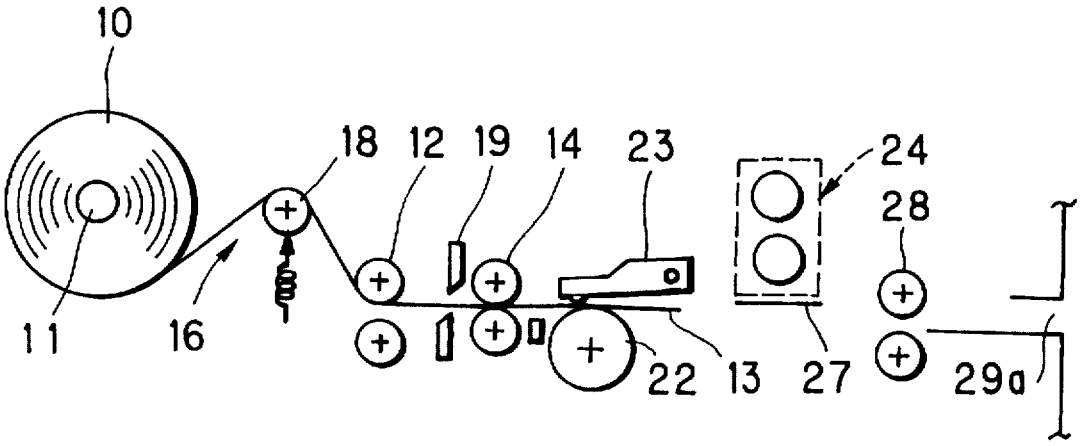
FIG. 2 is a schematic diagram showing the color thermosensitive printer during recording.

Referring to FIGS. 1 and 2, a recording paper roll 10 is fitted on a rotatable supply shaft 11. A paper feed roller pair 12 is disposed downstream of the supply shaft 11, and the roller pair 12 nips continuous color thermosensitive recording paper 13 to pull it out of the recording paper roll 10 and transport it toward a transport roller pair 14. These paper feed roller pair 12 and transport roller pair 14 each are constituted by a capstan roller driven by a motor and a pinch roller in tight contact with the capstan roller. In FIG. 1, the upper roller is the capstan roller and the lower roller is the pinch roller which rotates freely.

The paper feed roller pair 12 takes a nip state of nipping the continuous color thermosensitive recording paper 13 while it transports the tip of the paper toward the transport roller pair 14, and thereafter it takes a nip release state wherein the pinch roller moves away from the capstan roller. The transport roller pair 14 takes the nip release state while the paper feed roller pair 12 transports the tip of the continuous color thermosensitive recording paper 13, and takes the nip state after this paper transport until the print sequence is completed.

The continuous color thermosensitive recording paper 13 has as well known a cyan thermosensitive coloring layer, a magenta thermosensitive coloring layer, and a yellow thermosensitive coloring layer sequentially overlaid on a support layer. The uppermost yellow thermosensitive coloring layer has the highest heat sensitivity. The coloring ability of the yellow thermosensitive coloring layer is lost by near-ultraviolet rays of 420 nm, and that of the magenta thermosensitive coloring layer is lost by ultraviolet rays of 365 nm.

A loop forming section 16 is formed between the supply shaft 11 and paper feed roller pair 12 to accommodate a looped portion of the continuous color thermosensitive recording paper 13 formed when the paper is pulled back by the transport roller pair 14. In this embodiment, a dancer roller 18 biased upward by, for example, a spring 17, is mounted at the loop forming section 16 and pushes up the continuous color thermosensitive recording paper 13 to absorb deflection of the paper 13. A tension of this dancer roller 18 imparts a suitable braking force to the supply shaft 11 so as not to rotate the recording paper roll 10.

A cutter 19 is disposed between the paper feed roller pair 12 and transport roller pair 14. This cutter 19 has a movable upper blade and a fixed lower blade. After a full-color image is recorded, this cutter 19 cuts a recorded portion of the continuous color thermosensitive recording paper 13 into a print sheet. A sensor 20 for detecting the tip of the continuous color thermosensitive recording paper 13 is mounted at the side of the transport roller pair 14.

A platen roller 22 of hard rubber is mounted rotatably at the downstream position of the transport roller pair 14. A thermal head 23 is rotatably mounted facing the platen roller 22. The thermal head 23 presses and heats the continuous color thermosensitive recording paper 13 on the platen roller 22 to record a full-color image in a three-color frame sequential manner. As well known, the thermal head 23 has a number of heating elements disposed in line in the axial direction of the platen roller 22.

A fixing unit 24 is disposed downstream of the thermal head 23. The fixing unit 24 has a yellow ultraviolet lamp 25 for radiating near-ultraviolet rays in the wavelength range of 420 nm and a magenta ultraviolet lamp 26 for radiating ultraviolet rays in the wavelength range of 365 nm. Under this fixing unit 24, a shutter 27 capable of sliding is disposed.

A paper discharge roller pair 28 is disposed at the downstream position of the fixing unit 24 to nip a print sheet and discharge it from a discharge port 29*a*. Reference numeral 29 represents a casing for housing the above-described components, the paper discharge port 29*a* being integrally formed in this casing 29.

Figure 3:
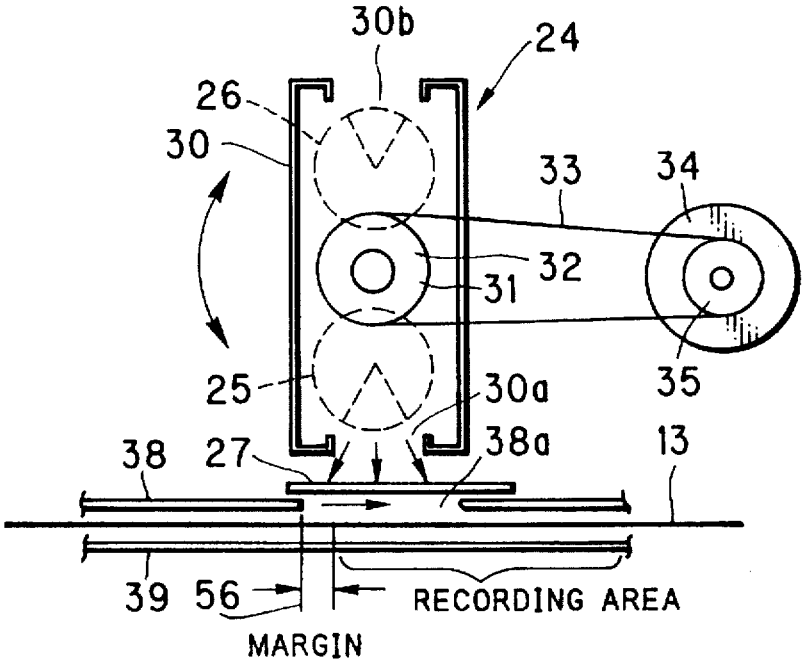
FIG. 3 is a schematic diagram of a fixing unit.

As shown in FIG. 3, the fixing unit 24 has a lamp house 30 in which the ultraviolet lamps 25 and 26 are accommodated. Upper and lower openings 30*a* and 30*b* for passing ultraviolet rays therethrough are formed in the lamp house 30. The lamp house 30 is fixedly mounted on a shaft 31 passing through the center of the lamp house 30. Opposite ends of this shaft 31 are rotatably supported by bearings (not shown), and a pulley 32 is fixed on this shaft 31. The pulley 32 is coupled via a belt 33 to a pulley 35 mounted on the shaft of a motor 34. As the motor 34 rotates, the lamp house 24 rotates by 180 degrees to select one of the ultraviolet lamps 25 and 26 and direct it toward the shutter 27. The shaft 31, pulley 32, belt 33, and motor 34 constitute a lamp switching mechanism. Instead of the pulley and belt, gear trains or the like may be used.

Guide plates 38 and 39 are disposed between the paper feed roller pair 14 and the paper discharge port (not shown) to form a transport path for the continuous color thermosensitive recording paper 13. Obviously, the guide plates are removed at the positions corresponding to the cutter 19 and roller pairs.

An exposure aperture 38*a* is formed in the guide plate 38 at the area facing the fixing unit 24 to define an ultraviolet ray radiation area. This exposure aperture 38*a* is opened and closed by the shutter 27. For the fixation, the shutter moves in the paper feed direction indicated by an arrow at the same speed as the transport speed of the continuous color thermosensitive recording paper 13, to thereby open the exposure aperture 38*a*. The exposure aperture 38*a* faces one of the openings 30*a* and 30*b* of the lamp house 30.

Figure 4:
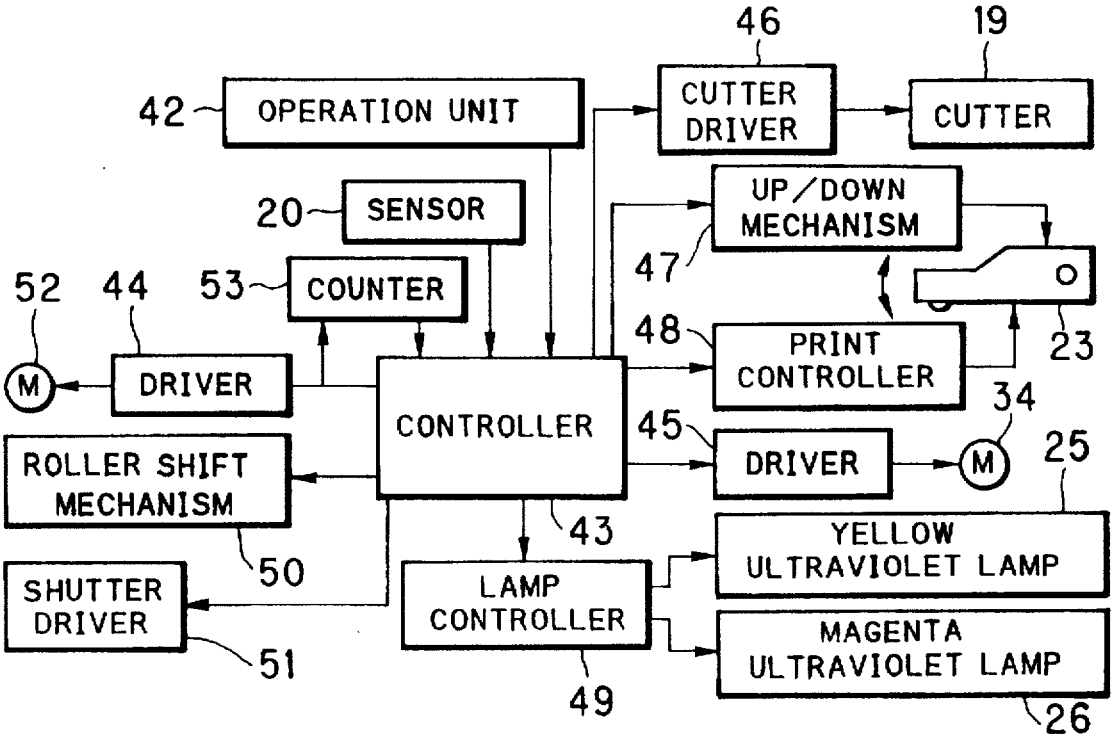
FIG. 4 is a block diagram showing an electrical configuration of the color thermosensitive printer.

Referring to FIG. 4, an operation unit 42 has a print start key and the like, and sends various commands to a controller 43. The controller 43 controls drivers 44 and 45, a cutter driver 46, an up/down mechanism 47, a print controller 48, a lamp controller 49, a roller shift mechanism 50, and a shutter driver 51.

The controller 43 sends a drive pulse and a rotation direction signal to the driver 44. The driver 44 rotates a pulse motor 52 in the normal or reverse direction to rotate the capstan rollers of the paper feed roller pair 12, transport roller pair 14, and paper discharge roller pair 28, and the platen roller 22 in the normal or reverse direction. The counter 53 starts counting when a tip detection signal of the sensor 20 is input, to count up when the pulse motor 52 rotates in the normal direction and count down when it rotates in the reverse direction, respectively in response to the drive pulse. The driver 45 controls the rotation of the motor 34 to rotate the lamp house 30.

Figure 5:
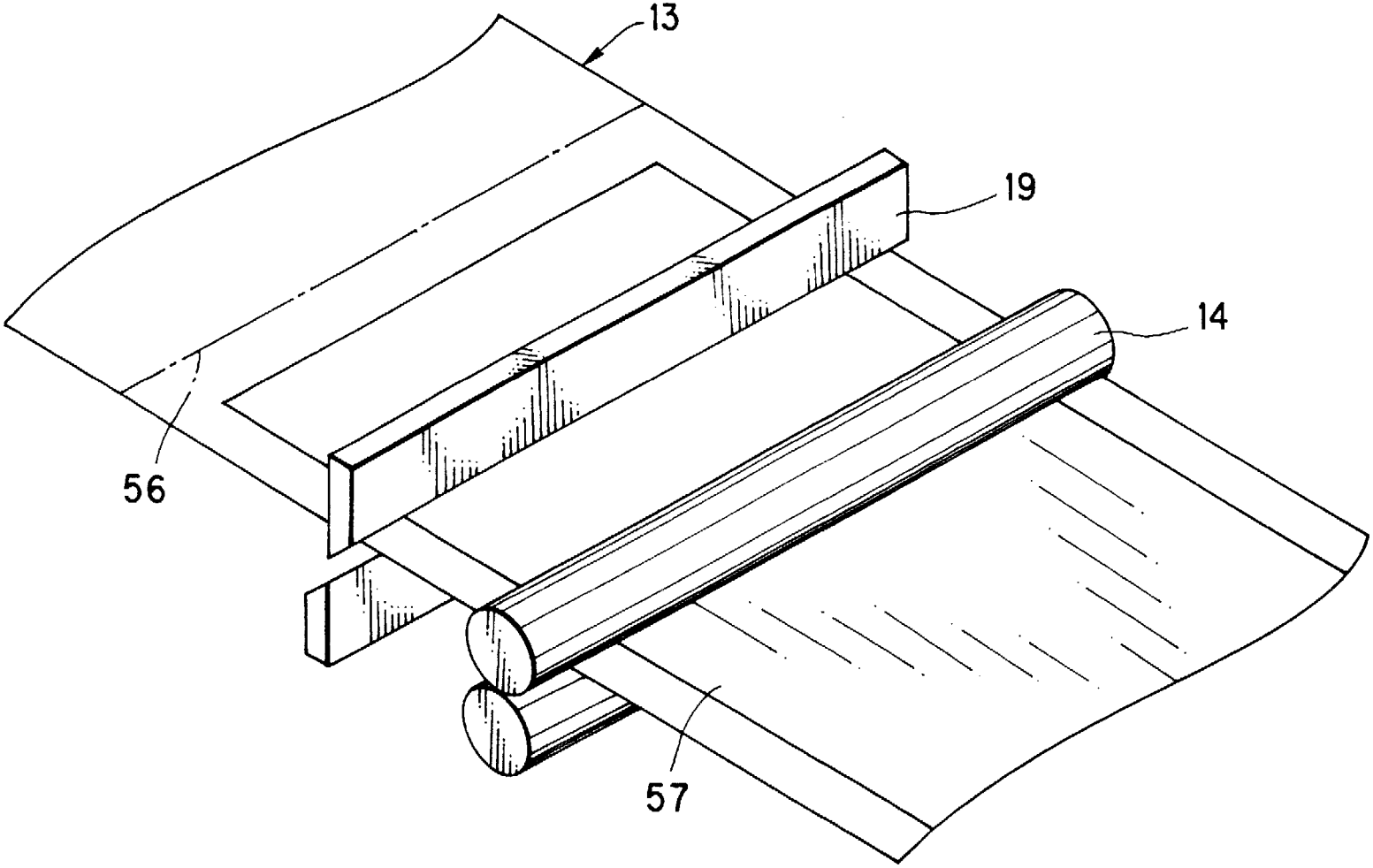
FIG. 5 is a perspective view of continuous color thermosensitive recording paper and a cutter.

The cutter driver 46 moves the movable blade of the cutter 19 up and down to cut the continuous color thermosensitive recording paper 13 at a preset cut position 56 (refer to FIG. 5) into a print sheet. The up/down mechanism 47 is constituted by a motor and a cam to press the thermal head 23 against the continuous color thermosensitive recording paper 13 or retract it therefrom. The print controller 48 is constituted by a memory which stores three-color image data of one frame and a head driver to drive each heating element of the thermal head 23 in accordance with image data of each color. These heating elements generate heat in accordance with image data and print color to develop color of the continuous color thermosensitive recording paper 13 at a desired density.

The lamp controller 49 controls light radiation of the yellow ultraviolet lamp 25 and magenta ultraviolet lamp 26. The roller shift mechanism 50 is constituted by solenoids and the like to move the pinch rollers of the paper feed roller pair 12, transport roller pair 14, and paper discharge roller pair 28. The shutter driver 51 is constituted by a pinion rotated by a motor and a rack formed on the shutter 27.

The operation of the above-described embodiment will be described. For exchange of a recording paper roll, a new recording paper roll 10 is fitted on the supply shaft 11 The continuous color thermosensitive recording paper 13 is pulled out of the recording paper roll 10 and the tip thereof is inserted between the paper feed roller pair 12 in the nip release state, and thereafter, the pinch roller is moved to enter the nip state.

After image data to be printed is fetched, the operation unit 42 is manipulated to instruct a print operation. Then, the controller 44 causes the driver 43 to rotate the pulse motor 52. The pulse motor 52 rotates the paper feed roller pair 12 to pull the continuous color thermosensitive recording paper 13 out of the recording paper roll 10 to feed the paper 13 toward the transport roller pair 14 having the nip release state. When the tip of the continuous color thermosensitive recording paper 13 reaches the sensor 20, the tip detection signal is sent from the sensor 20 to the controller 43.

Upon reception of the tip detection signal, the controller 43 causes the roller shift mechanism 50 to move the pinch roller and make the transport roller in the nip state. In this nip state, the continuous color thermosensitive recording paper 13 is transported because the capstan roller is rotated by the pulse motor 52. Upon detection of the tip, the count operation of the counter 53 starts and counts the number of drive pulses sent to the pulse motor 52 to measure the feed amount of the continuous color thermosensitive recording paper 13.

During the first pull-out operation of the continuous color thermosensitive recording paper 13, the thermal head 23 is away from the platen roller 22 so that the paper 13 is transported therebetween toward the fixing unit 24. As shown in FIG. 3, if it is judged, from the feed amount of the continuous color thermosensitive recording paper 13 measured with the counter, that the preset cut position 56 is at the upstream end of the exposure aperture 38*a*, the driver 44 stops the pulse motor 52. Next, as shown in FIG. 2, the roller shift mechanism 50 retracts the pinch roller of the paper feed roller pair 12 to make it in the nip release state.

The controller 43 causes the driver 44 to rotate the pulse motor 52 in the reverse direction and start the first pull-back operation of the continuous color thermosensitive recording paper 13. In accordance with the pull-back amount of the continuous color thermosensitive recording paper 13, the dancer roller 18 moves and enters the loop forming section 16 as shown in FIG. 2. In order for the recording paper roll 10 not to be rotated by the motion of the dancer roller 18, a suitable braking force is applied to the supply shaft 11.

During the pull-back of the continuous color thermosensitive recording paper 13, the counter 53 counts down. From the count of the counter 53, the position of the back end of a recording area 57 (refer to FIG. 5) can be known. As the back end of the recording area 57 comes near the thermal head 23, the controller 43 causes the up/down mechanism 47 to swing the thermal head 23 and press the continuous color thermosensitive recording paper 13.

As the thermal head 23 faces the back end of the recording area 57, the print controller 48 drives the thermal head 23 in accordance with yellow image data to record the yellow image one line after another. The pull-back speed of the continuous color thermosensitive recording paper 13 may be the same for all three colors, or may be changed for each color to realize high speed printing. In this case, since the yellow image is formed with the smallest heat energy, the pull-back speed is made highest, and it is made lowest for recording a cyan image. In this embodiment, since the continuous color thermosensitive recording paper 13 is merely fed forward, this forward feed speed may be made higher than the pull-back speed to speed up the printing operation.

Even after the yellow image is recorded in the recording area 57, the continuous color thermosensitive recording paper 13 continues to be pulled back. When the tip of the continuous color thermosensitive recording paper 13 is detected with the sensor 20, the reverse rotation of the pulse motor 52 stops. At the same time, the up/down mechanism 47 operates to retract the thermal head 23 and the counter 53 is reset.

As the pulse motor 52 rotates again in the normal direction for the second pull-out of the continuous color thermosensitive recording paper 13, a predetermined amount of the looped and stocked continuous color thermosensitive recording paper 13 is fed while the dancer roller 18 is lowered.

After the second pull-out, the yellow ultraviolet lamp 25 is turned on and the shutter driver 51 makes the shutter 27 slide in the feed direction at a constant speed V. In this manner, the shutter 27 at the closed position is moved toward the open position to gradually open the exposure aperture 38*a*. Near-ultraviolet rays of 420 nm radiated from the yellow ultraviolet lamp 25 pass through the gradually opened exposure aperture 38*a* and are applied to the continuous color thermosensitive recording paper 13. Since the shutter 27 is opened from the upstream side of the exposure aperture 38*a*, near-ultraviolet rays are gradually applied from the preset cut position 56 side, i.e., from the back end side of the recording area 57, and the yellow image starts being fixed.

At the same time when the exposure aperture 38*a* is completely opened, the pulse motor 52 starts being rotated in the reverse direction to pull back the continuous color thermosensitive recording paper 13 at the constant speed V. Therefore, the ultraviolet ray exposure amount is the same over the whole surface of the continuous color thermosensitive recording paper 13 faced to the exposure aperture 38*a* shown in FIG. 3. The area other than the recording area 57 is also fixed by a constant amount of near-ultraviolet rays each time it passes through the ultraviolet ray exposure area. When the tip of the continuous color thermosensitive recording paper 13 passes through the ultraviolet ray exposure area, the yellow ultraviolet lamp 25 is turned off.

As the recording area 57 with the fixed yellow image reaches the thermal head 23, the thermal head 23 is lowered to press the continuous color thermosensitive recording paper 13. In accordance with magenta image data, the thermal head 23 is driven to record the magenta image one line after another on the continuous color thermosensitive recording paper 13. In recording the magenta image, the thermal head 23 generates a larger heat energy than in recording the yellow image.

After the magenta image is recorded, the third pull-out starts to feed the continuous color thermosensitive recording paper 13 by a predetermined amount. During or after the third pull-out, the motor 34 rotates to rotate the lamp house 24 by 180 degrees and make the opening 30*b* face the exposure aperture 38*a*. At the same time, the shutter driver 51 slides the shutter 27 to close the exposure aperture 38*a*.

Next, after the magenta ultraviolet lamp 26 is turned on, the shutter 27 is slid at the constant speed to open the exposure aperture 38*a*. After the exposure aperture 38*a* is completely opened, the continuous color thermosensitive recording paper 13 is pulled back at a speed the same as the slide speed of the shutter 27. In this manner, a predetermined amount of the ultraviolet rays of 365 nm is applied to the continuous color thermosensitive recording paper 13 and the magenta image is fixed. After the completion of the third pull-back, the magenta ultraviolet lamp 26 is turned off and the shutter 27 is closed. Thereafter, the motor 34 rotates to rotate the lamp house 24 by 180 degrees to make the yellow ultraviolet lamp 25 face the exposure aperture 38*a*.

During the third pull-back, the thermal head 23 generates the highest heat energy in accordance with cyan image data to record the cyan image one line after another in the recording area 57. After the cyan image is recorded, the thermal head 23 retracts from the platen roller 22. After the record completion of the cyan image, the full-color image is formed in the recording area 57.

As the tip of the continuous color thermosensitive recording paper 13 is detected with the sensor 20, the reverse rotation of the pulse motor 52 stops to terminate the third pull-back and at the same time the counter 53 is reset.

Next, the pulse motor 52 rotates in the normal direction to feed the continuous color thermosensitive recording paper 13. During this feeding, the counter 53 counts the drive pulses to check the preset cut position 56. When the preset cut position 56 reaches the cutter 19, the pulse motor 52 stops temporarily. Next, the cutter driver 46 drives the cutter 19 to cut the paper 13 at the preset cut position into a print sheet.

The tip of the print sheet is at the position of the paper discharge roller pair 28 when the print sheet is cut. After the cutting, the paper discharge roller pair 28 takes the nip state by moving the pinch roller. The paper discharge roller pair 28 as well as the transport roller pair 14 rotate to discharge the print sheet from the paper discharge port 29*a* onto a tray or the like.

After the paper discharge, the pinch rollers of the transport roller pair 14 and paper discharge roller pair 28 move and the nip release state enters. The new tip of the continuous color thermosensitive recording paper 13 stops at the cut position.

As a printing operation is again instructed from the operation unit 42, the pinch roller of the paper feed roller pair 12 moves to nip the tip of the continuous color thermosensitive recording paper 13. As described earlier, as the paper feed roller pair 12 is rotated by the pulse motor 52, the continuous color thermosensitive recording paper 13 is pulled out of the recording paper roll 10 and fed toward the transport roller pair 14. Thereafter, by the sequence described above, a full-color image is recorded by the three pull-back operations, and the paper 13 is cut into a print sheet.

In order to omit the shutter 27, the continuous color thermosensitive recording paper 13 may be fed until the back end of the recording area passes through the fixing unit 24. In this case, the fixing unit 24 may be turned on at the same time when the pull-back operation is performed, or it may be turned on when the back end of the recording area faces the downstream end position of the exposure aperture 38*a*. In the former case, ultraviolet rays are applied even to the outside of the recording area and the ultraviolet exposure area loses the coloring ability. It is easy to cut the paper by leaving part of this area as a white frame. In order to reduce the margin area, the continuous color thermosensitive recording paper 13 is transported a little after the print sheet with the printed area is cut, to thereafter cut the tip area of the continuous color thermosensitive recording paper 13 with the cutter 19.

In the above embodiment, immediately before the magenta image is recorded, the yellow image is fixed by the yellow ultraviolet lamp 25. Instead, the fixation by the yellow ultraviolet lamp 25 may be performed during the second pull-out operation after recording the yellow image. In this case, when the preset cut position 56 reaches the position shown in FIG. 3, the normal rotation of the pulse motor 52 is stopped and at the same time the shutter 27 is moved in the direction opposite to the arrow direction at the same speed as the feed speed of the paper 13 to close the exposure aperture 38*a*.

Further, the yellow ultraviolet lamp 25 may be turned on starting from the second pull-out which is performed shortly before the second pull-back for recording the magenta image, to thereby fix the yellow image during both the second pull-out and second pull-back. During the second pull-out, the continuous color thermosensitive recording paper is fed at a feed speed of V1 while the yellow ultraviolet lamp 25 is turned on. When the second pull-out is completed, the shutter is moved in the pull-back direction to close the exposure aperture. Next, the shutter is moved in the pull-out direction at a speed of V2 to retract it from the exposure aperture 38*a*, and the continuous color thermosensitive recording paper is subjected to the second pull-back at the speed of V2. When the second pull-back is completed, the yellow ultraviolet lamp 25 is turned off.

Still further, the continuous color thermosensitive recording paper 13 may be fed until the recording area 57 moves past the exposure aperture 38*a* and the present cut position 56 reaches the end of the exposure aperture 38*a*. For fixing the yellow image, the yellow ultraviolet lamp 25 is first turned on and next the shutter 27 is moved in the pull-out direction at a constant speed V to change the closed position to the open position. At the same time when the shutter 27 is set to the open position, the continuous color thermosensitive recording paper 13 is fed back at the constant speed V. During this pull-back, the recording area 57 moves past the exposure aperture so that the recording area 57 is uniformly fixed with ultraviolet rays radiated from the yellow ultraviolet lamp 25.

During the third pull-out after recording the magenta image, the magenta ultraviolet lamp 26 may be turned on to fix the magenta image. Color thermosensitive recording paper is pale yellow at the area not recorded, and this area can be bleached by applying ultraviolet rays radiated from the magenta ultraviolet lamp 26. If an amount of ultraviolet rays is too large when the yellow image is fixed, the magenta coloring characteristics are degraded. It is therefore necessary not to fix excessively. The problem of excessive fixation is not associated with the magenta image. Therefore, the magenta ultraviolet lamp 26 may be turned on continuously until the paper discharge is completed after recording the magenta image. Further, the shutter 27 may be set to the open state before the magenta ultraviolet lamp 26 is turned on.

The continuous color thermosensitive recording paper 13 may be wound about the recording paper roll 10 during the paper 13 is fed back, by driving the supply shaft 11 by a motor. In this case, the loop forming section 16 can be omitted.

In the above embodiment, the components of the thermal printer are arranged in the order of a paper feed unit set with the recording paper roll 10 and having the paper feed roller pair 12, a cutter unit having the cutter, a nip transport unit having the transport roller pair 14, a print unit having the thermal head 23, and a fix unit having the fixing unit 24. The mount order of the cutter unit, nip transport unit, print unit, and fix unit at the downstream side of the paper feed unit may be changed.

Figure 6:
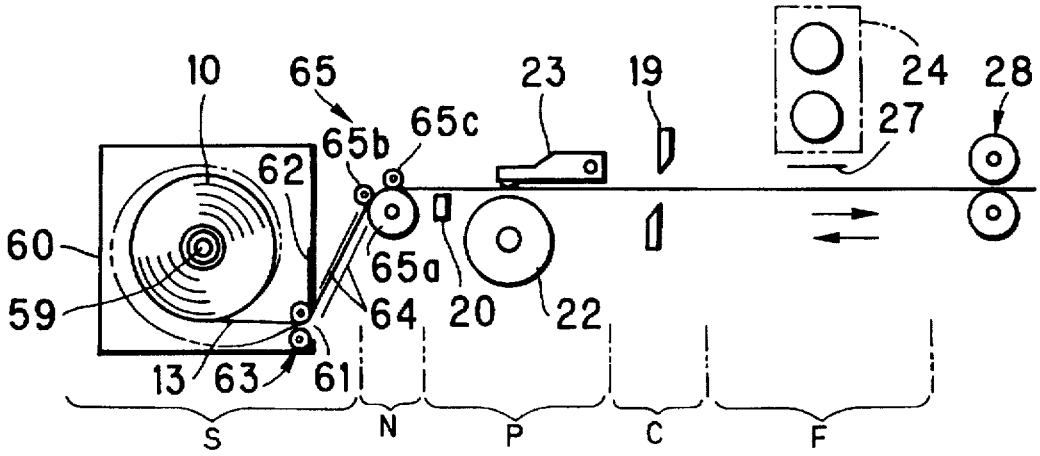
FIG. 6 is a schematic diagram of a color thermosensitive printer with a transport roller pair, a thermal head, a cutter, and a fixing unit disposed in this order.

FIG. 6 shows an embodiment of a thermal printer in which a paper feed unit S, a nip transport unit N, a print unit P, a cutter unit C, and a fix unit F are disposed in this order. Like components to those shown in FIG. 1 are represented by using identical reference numerals. In this embodiment, a magazine 60 is used which has a light tight magazine body and a shaft 59 capable of being dismounted from the magazine body. This shaft 59 is inserted into the winding core of a recording paper roll 10, and accommodated in the magazine body together with the recording paper roll 10.

The magazine 60 is provided with a lid member 62 and a paper feed roller pair 63. The lid member 62 opens and closes an outlet 61. In the stock state, the lid member 62 energized by a spring or the like closes the outlet 61 to prevent moisture and dust from entering the inside of the magazine body.

As the magazine 60 is mounted on the thermal printer, a projection formed at the mount position pushes a cooperation mechanism of the magazine 60 so that the lid member 62 deforms upward to open the outlet 61. After the lid member 62 is set to the open state, the paper feed roller pair 63 is rotated by a motor of the color thermal printer to feed the tip of continuous color thermosensitive recording paper 13 toward the transport roller pair 65. After the continuous color thermosensitive recording paper 13 is nipped with the transport roller pair 65, the nip state of the paper feed roller pair 63 is released.

The transport roller pair 65 of the nip transport unit N is disposed on the oblique upper side of the outlet 61. The transport roller pair 65 is constituted by a capstan roller 65*a* and two pinch rollers 65*b* and 65*c*. These two pinch rollers 65*b* and 65*c* wind the continuous color thermosensitive recording paper 13 about the capstan roller 65*a*. Therefore, the paper 13 is curved in the direction opposite to the winding direction of the recording paper roll 10 to remove a curl of the paper 13. A guide plate 64 is provided between the outlet 61 and the transport roller pair 65. During the pull-out, the tip of the continuous color thermosensitive recording paper 13 is guided by the transport roller pair 65, and during the pull-back, the continuous color thermosensitive recording paper 13 is wound back into the magazine 60 and accommodated therein in a loose state.

On the downstream side of the transport roller pair 65, a tip sensor 20, a thermal head 23, a cutter 19, a fixing unit 24, and a paper discharge roller pair 28 are disposed in this order. The thermal head 23 is fixedly mounted, and the platen roller 22 is mounted movable up and down. During the thermal printing, the platen roller 22 moves upward to tightly press the continuous color thermosensitive recording paper 13 against the thermal head 23.

Figure 7:
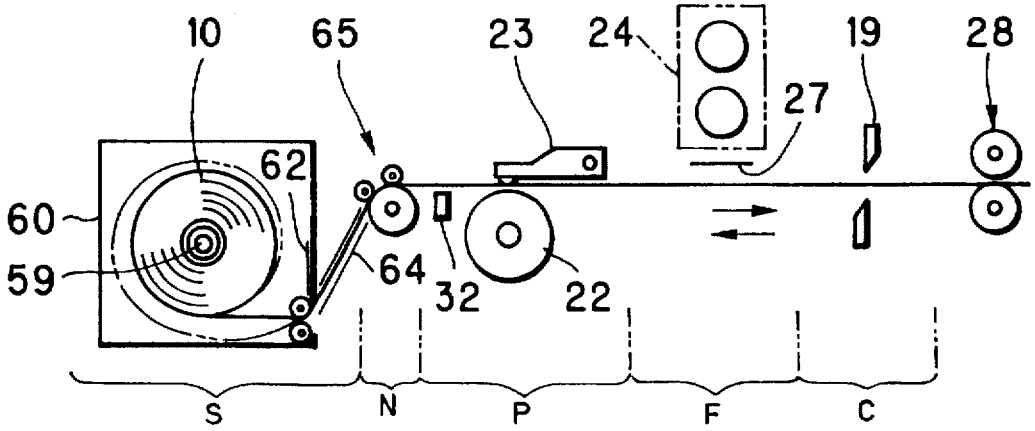
FIG. 7 is a schematic diagram of a color thermosensitive printer with a transport roller pair, a thermal head, a fixing unit, and a cutter disposed in this order.
Figure 9:
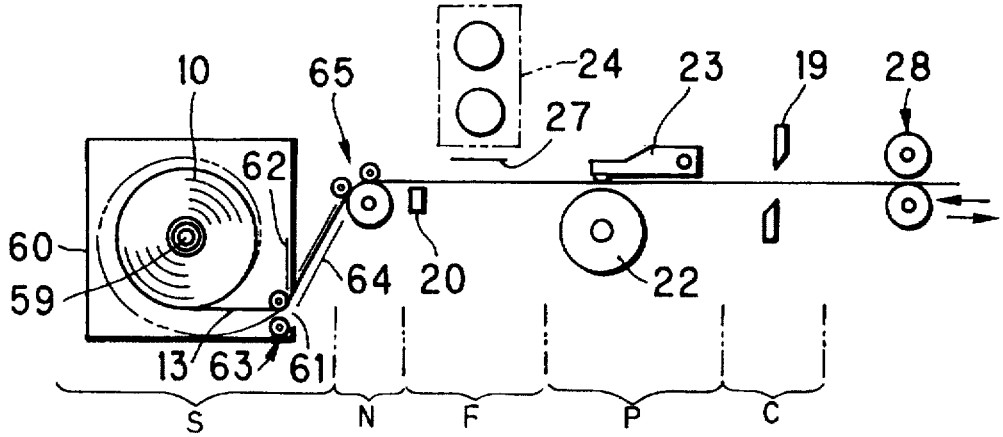
FIG. 9 is a schematic diagram of a color thermosensitive printer with a transport roller pair, a fixing unit, a thermal head, and a cutter disposed in this order.
Figure 10:
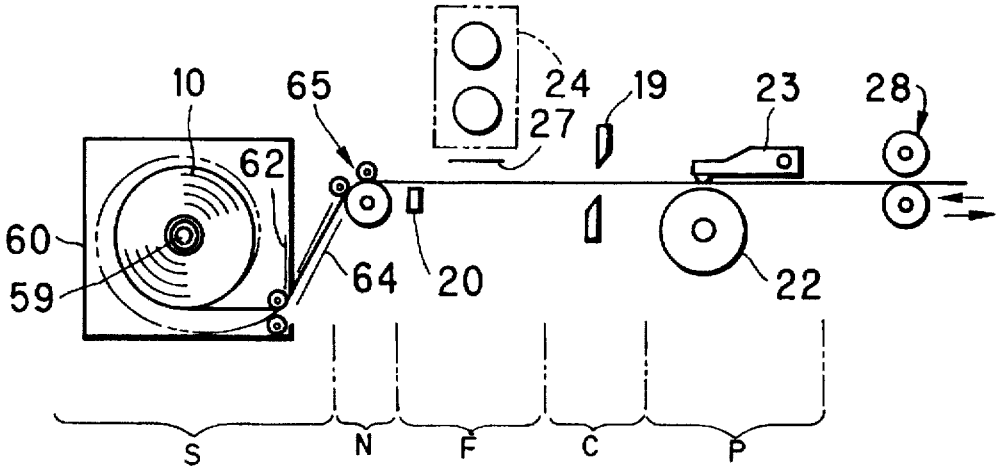
FIG. 10 is a schematic diagram of a color thermosensitive printer with a transport roller pair, a fixing unit, a cutter, and a thermal head disposed in this order.

The thermal printer shown in FIG. 7 has the cutter unit C and fix unit F interchanged with respect to the thermal printer shown in FIG. 6, and has the paper feed unit S, nip transport unit N, print unit P, fix unit F, and cutter unit C disposed in this order. The thermal printer shown in FIG. 8 has the cutter unit C shown in FIG. 6 but placed between the nip transport unit N and print unit P, and has the paper feed unit S, nip transport unit N, cutter unit C, print unit P, and fix unit F disposed in this order. The thermal printer shown in FIG. 9 has the print unit P and fix unit F shown in FIG. 7 but interchanged, and has the paper feed unit S, nip transport unit N, fix unit F, print unit P, and cutter unit C disposed in this order. The thermal printer shown in FIG. 10 has the print unit P and cutter unit C shown in FIG. 9 but interchanged, and has the paper feed unit S, nip transport unit N, fix unit F, cutter unit C, and print unit P disposed in this order. The thermal printer shown in FIG. 11 has the fix unit F and cutter unit C shown in FIG. 10 but interchanged, and has the paper feed unit S, nip transport unit N, cutter unit C, fix unit F, and print unit P disposed in this order.

Figure 11:
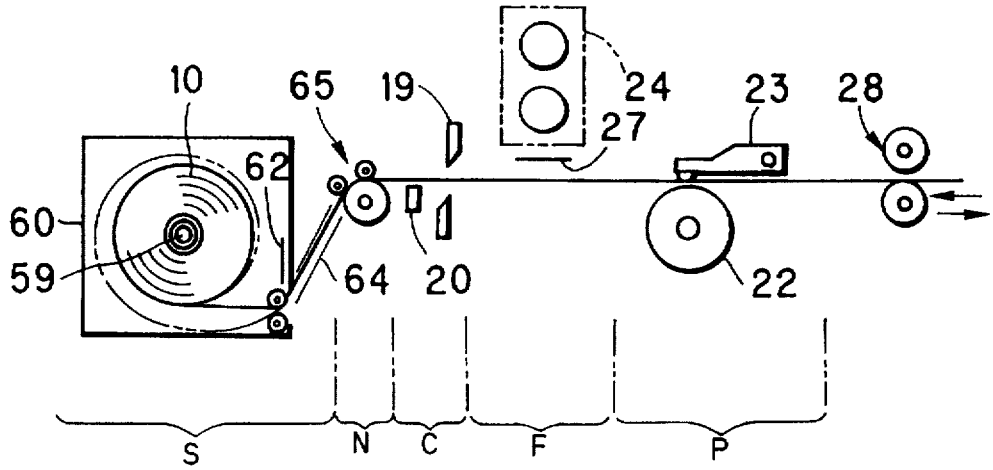
FIG. 11 is a schematic diagram of a color thermosensitive printer with a transport roller pair, a cutter, a fixing unit, and a thermal head disposed in this order.
Figure 12:
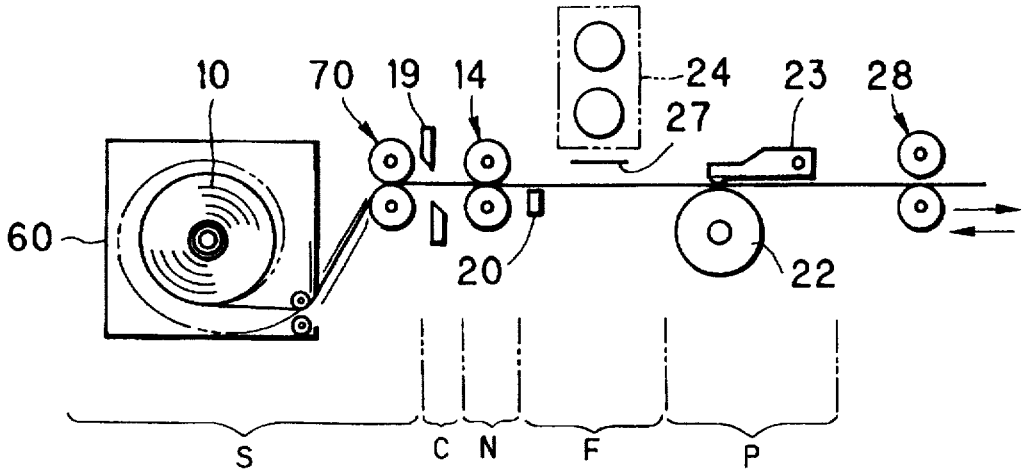
FIG. 12 is a schematic diagram of a color thermosensitive printer with a cutter, a transport roller pair, a fixing unit, and a thermal head disposed in this order.

The thermal printer shown in FIG. 12 has the nip transport unit N and cutter unit C shown in FIG. 11 but interchanged, and has the paper feed unit S, cutter unit C, nip transport unit N, fix unit F, and print unit P disposed in this order. The thermal printer shown in FIG. 13 has the nip transport unit N and fix unit F shown in FIG. 12 but interchanged, and has the paper feed unit S, cutter unit C, fix unit F, nip transport unit N, and print unit P disposed in this order. The thermal printer shown in FIG. 14 has the cutter unit C and fix unit F shown in FIG. 13 but interchanged, and has the paper feed unit S, fix unit F, cutter unit C, nip transport unit N, and print unit P disposed in this order. The thermal printer shown in FIG. 15 has the cutter unit C and nip transport unit N shown in FIG. 14 but interchanged, and has the paper feed unit S, fix unit F, nip transport unit N, cutter unit C, and print unit P disposed in this order. The thermal printer shown in FIG. 16 has the cutter unit C and print unit P shown in FIG. 15 but interchanged, and has the paper feed unit S, fix unit F, nip transport unit N, print unit, and cutter unit C disposed in this order.

Figure 8:
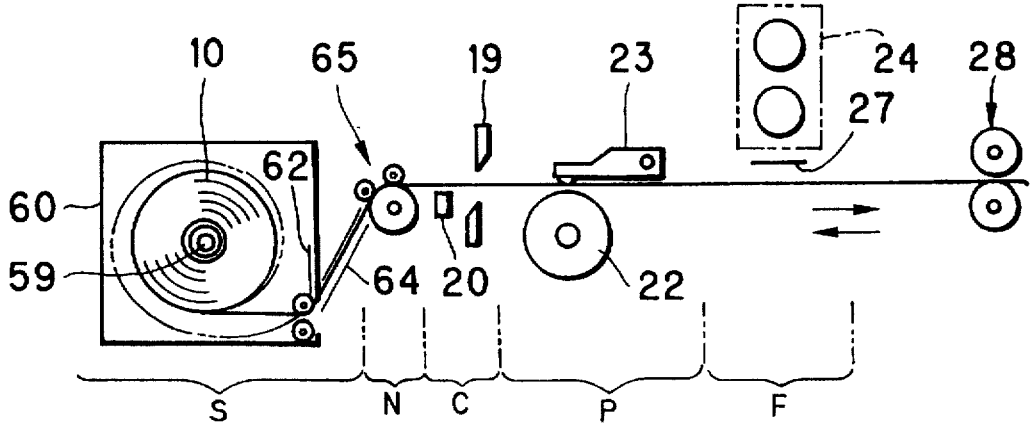
FIG. 8 is a schematic diagram of a color thermosensitive printer with a transport roller pair, a cutter, a thermal head, and a fixing unit disposed in this order.

In the examples shown in FIGS. 6 to 8, since the fixing unit is at the downstream side of the thermal head, a full-color image can be recording in the similar manner to that described with FIG. 1. After the preset cut position is fed to the cutter 19, a print sheet is cut with the cutter 19 and discharged by the paper discharge roller pair 28. After this paper discharge, a new tip of the continuous color thermosensitive recording paper 13 is set to the position where the sensor 32 detects the tip.

In the examples shown in FIGS. 9 to 16, since the fixing unit is at the upstream side of the thermal head, as the yellow image is recorded, it is also fixed. Similarly, as the magenta image is recorded, it is also fixed.

Figure 13:
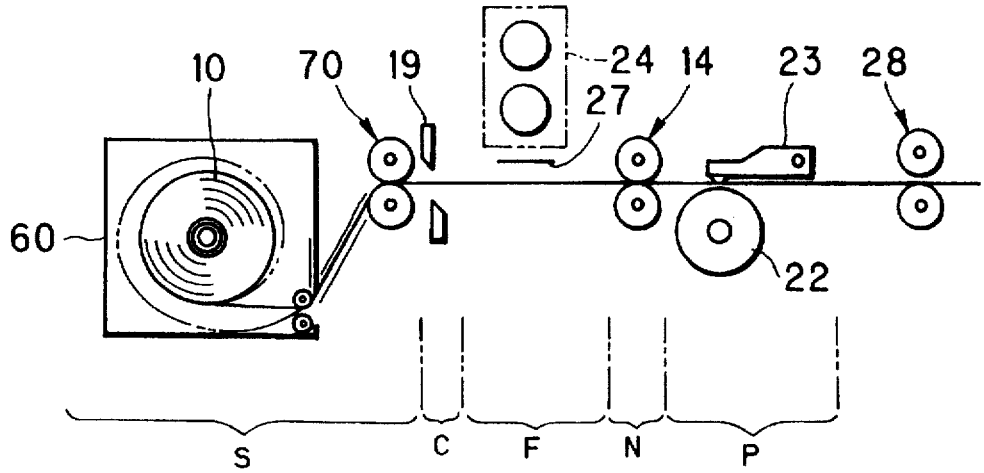
FIG. 13 is a schematic diagram of a color thermosensitive printer with a cutter, a fixing unit, a transport roller pair, and a thermal head disposed in this order.
Figure 14:
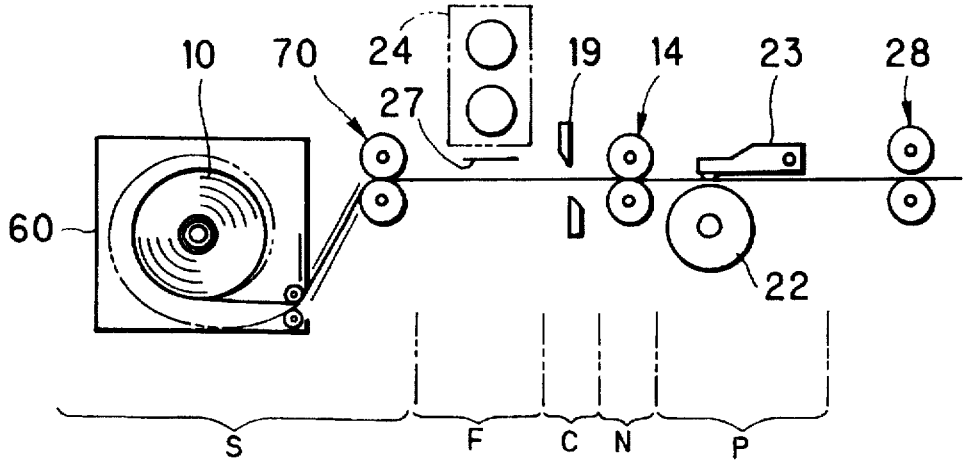
FIG. 14 is a schematic diagram of a color thermosensitive printer with a fixing unit, a cutter, a transport roller pair, and a thermal head disposed in this order.

In the examples shown in FIGS. 12 to 14, since the cutter is at the upstream side of the transport roller pair, it is necessary to provide a paper feed roller pair 70 to transport the tip of the continuous color thermosensitive recording paper 13 to the transport roller pair 14 after the paper 13 is cut.

Figure 15:
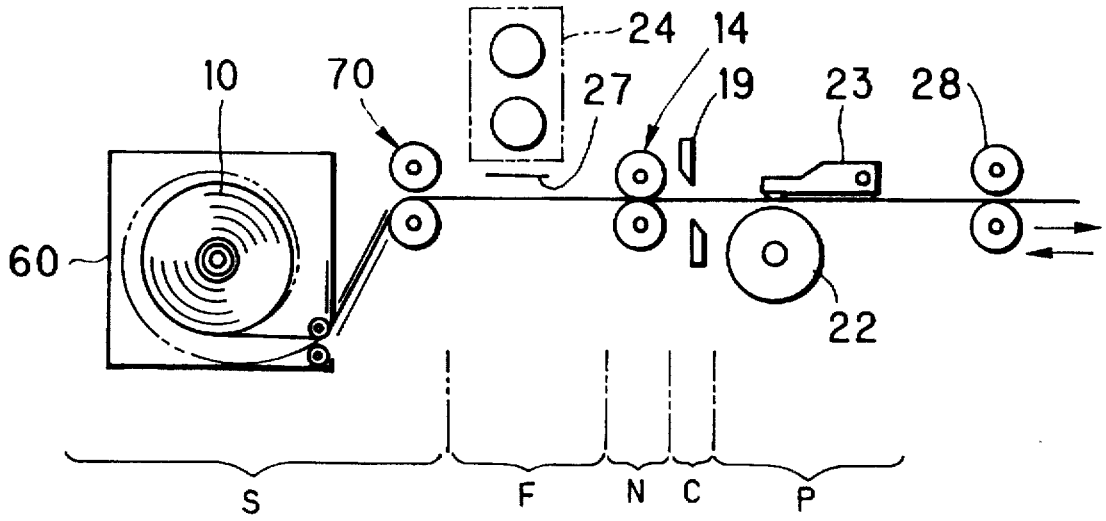
FIG. 15 is a schematic diagram of a color thermosensitive printer with a fixing unit, a transport roller pair, a cutter and a thermal head disposed in this order.
Figure 16:
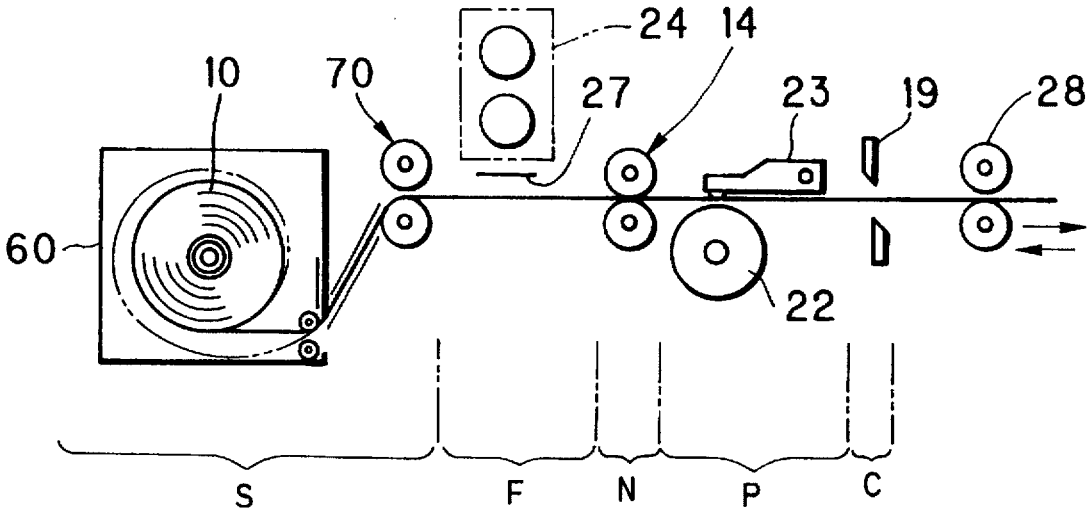
FIG. 16 is a schematic diagram of a color thermosensitive printer with a fixing unit, a transport roller pair, a thermal head, and a cutter disposed in this order.

In the examples shown in FIGS. 15 and 16, since the fixing unit is disposed at the upstream side of the transport roller pair 14, the paper feed roller pair 70 is provided. Since the tip of the continuous color thermosensitive recording paper 13 is fed back to the transport roller pair 14, a margin corresponding to the distance between the fixing unit 24 and transport roller pair 14 is formed. If the margin is to be reduced, the tip of the continuous color thermosensitive recording paper 13 may be fed back to the fixing unit 24 after it passes through the transport roller pair 14. In this case, the paper feed roller pair 70 rotates together with the transport roller pair 14 to transport the continuous color thermosensitive recording paper 13.

In the examples shown in FIGS. 6 to 16, during the pull-back of the continuous color thermosensitive recording paper 13, only one of recording an image and fixing the image may be executed. For example, during the first pull-back, a yellow image is recorded, and during the second pull-back, it is fixed. In this case, the pull-back is performed five times. If bleaching is desired, the pull-back is performed six times.

In each of the above embodiments, the platen roller 22 is used. Instead, a fixed platen plate may be used. The paper feed roller pair, transport roller pair, and paper discharge roller pair may be always in the nip state. In this case, synchronously with the rotation of the transport roller pair, the remaining roller pairs are rotated in the same direction.

The yellow ultraviolet lamp may be turned on for fixation only during the second pull-back period, during the pull-out period between the first and second pull-back operations, or during both the periods. The magenta ultraviolet lamp may be turned on for fixation only during the third pull-back period, during the pull-out period between the second and third pull-back operations, or during both the periods. The shutter and transport roller pair may be driven by the same motor.

Although the system scale becomes bulky, the magenta ultraviolet lamp and yellow ultraviolet lamp may be juxtaposed laterally, for example, at the downstream side of the thermal head. The shutter is disposed at the yellow ultraviolet lamp. In recording a yellow image, transporting of the continuous color thermosensitive recording paper is stopped when the preset cut position passes through the thermosensitive coloring layer. Next, after the yellow ultraviolet lamp is turned on, the continuous color thermosensitive recording paper is fed back at a constant speed V. At the same time, while the end of the shutter aligns with the preset cut position, the shutter is moved at the speed V in the direction the same as the feed direction of the continuous color thermosensitive recording paper. The yellow ultraviolet lamp is gradually released to fix the continuous color thermosensitive recording paper.

The invention is applicable, in addition to direct thermal printers using color thermosensitive recording paper, to color thermal transfer printers using an ink ribbon or ink film to transfer ink to continuous color recording paper. In this case, the fixing unit is not necessary.

The present invention has been described in connection with the preferred embodiments. The invention is not limited only to the above embodiments. It is apparent to those skilled in the art that various modifications, improvements, combinations and the like can be made without departing from the scope of the appended claims.

I claim:

1. A color thermal printer for recording a color image on continuous recording paper, wherein the continuous recording paper is continuous color thermosensitive recording paper having a first thermosensitive coloring layer for developing a first color, a second thermosensitive coloring layer for developing a second color and a third thermosensitive coloring layer for developing a third color, the first to third thermosensitive coloring layers being sequentially overlaid on a support in order from a top of the continuous recording paper, the first thermosensitive coloring layer having a highest heat sensitivity, the first and second thermosensitive coloring layers being fixable by ultraviolet rays of a first wavelength range and a second wavelength range respectively, the color thermal printer comprising:

a paper feed unit in which a roll of the continuous recording paper is set;

a transport roller pair for nipping the continuous recording paper pulled out of the roll, and alternately performing pull-out and pull-back of the continuous recording paper;

a thermal head disposed at a downstream side of said transport roller pair for recording an image of the first color in a recording area of the continuous recording paper during a first pull-back operation, recording an image of the second color during a second pull-back operation, and recording an image of the third color during a third pull-back operation;

a cutter disposed at the downstream side of said paper feed unit for cutting the continuous recording paper into a print sheet;

a fixing unit disposed at the downstream side of said paper feed unit for selectively radiating a first ultraviolet ray specific to the first thermosensitive coloring layer and a second ultraviolet ray specific to the second thermosensitive coloring layer; and a shutter disposed between said fixing unit and said continuous color thermosensitive recording paper, said shutter moving between a light shielding position for covering an ultraviolet exposure area to shield light and an open position retracted from said ultraviolet exposure area.

2. The color thermal printer according to claim 1, wherein the first color is yellow, the second color is magenta, and the third color is cyan.

3. The color thermal printer according to claim 1, wherein said fixing unit has a first ultraviolet lamp for radiating said first ultraviolet ray in the first wavelength range and a second ultraviolet lamp for radiating said second ultraviolet ray in the second wavelength range.

4. The color thermal printer according to claim 3, wherein said first ultraviolet ray of the first wavelength range is applied to said continuous color thermosensitive recording paper during the second pull-back operation or a pull-out operation between the first and second pull-back operations.

5. The color thermal printer according to claim 4, wherein said second ultraviolet ray of the second wavelength range is applied to said continuous color thermosensitive recording paper during the third pull-back operation or a pull-out operation between the second and third pull-back operations.

6. The color thermal printer according to claim 4, wherein after the image of the third color is recorded, the image of the third color is fixed and said continuous color thermosensitive recording paper is bleached, while said second ultraviolet ray of the second wavelength range is applied.

7. The color thermal printer according to claim 3, wherein during a pull-out operation after the first pull-back operation, said transport roller pair stops when a preset cut position of said continuous color thermosensitive recording paper reaches an end of said ultraviolet exposure area on a side of said thermal head near entry of the recording area to said ultraviolet exposure area, said first ultraviolet lamp turns on before a start of the second pull-back operation of said continuous color thermosensitive recording paper to radiate said first ultraviolet ray of the first wavelength range, during turn-on of said first ultraviolet lamp, said shutter is moved at a constant speed V in a pull-out direction and set from the light shielding position to the open position, and said transport roller pair starts the second pull-back operation of said continuous color thermosensitive recording paper at the constant speed V when said shutter is set to the open position.

8. The color thermal printer according to claim 3, wherein said transport roller pair transports said continuous color thermosensitive recording paper at a constant speed V1 during a pull-out operation after the first pull-back operation, and stops when a preset cut position of said continuous color thermosensitive recording paper reaches an end of said ultraviolet exposure area on a side of said thermal head near entry of the recording area to said ultraviolet exposure area, said first ultraviolet lamp turns on during the pull-out operation to radiate said first ultraviolet ray of the first wavelength and fix the image of the first color, upon completion of the pull-put operation, said shutter moves from the open position to the light shielding position at the constant speed V1 in a pull-back direction, and then moves from the light shielding position to the open position at a constant speed V2 in a pull-out direction, and said transport roller pair transports said continuous color thermosensitive recording paper at the constant speed V2 to perform the second pull-back operation after said shutter is set to the open position, while turning on said first ultraviolet lamp.

9. The color thermal printer according to claim 3, wherein said transport roller pair starts transporting said continuous color thermosensitive recording paper during a pull-out operation after the first pull-back operation, and stops when a preset cut position of said continuous color thermosensitive recording paper reaches an end of said ultraviolet exposure area on a side remote from said thermal head with respect to passage of the recording area through said ultraviolet exposure area, said first ultraviolet lamp turns on after the pull-out operation is stopped, after said first ultraviolet lamp turns on, said shutter moves at a constant speed V in a pull-back direction from the light shielding position toward the open position, and said transport roller pair transports said continuous color thermosensitive recording paper at the constant speed V to perform the second pull-back operation after said shutter is set to the open position, while turning on said first ultraviolet lamp.

10. The color thermal printer according to claim 9, further comprising a single drive unit for driving said shutter and said transport roller pair.

11. The color thermal printer according to claim 3, wherein said paper feed unit comprises a paper feed roller pair which nips a tip of said continuous color thermosensitive recording paper and transports the tip toward said transport roller pair.

12. The color thermal printer according to claim 11, further comprising a loop forming unit disposed between said paper feed roller pair and the roll of continuous recording paper for accommodating said continuous color thermosensitive recording paper in a loop shape during the first, second and third pull-back operations.

13. The color thermal printer according to claim 3, further comprising a lamp switching mechanism for positioning one of said first and second ultraviolet lamps toward said ultraviolet exposure area.

14. The color thermal printer according to claim 3, wherein said paper feed unit, said transport roller pair, said cutter, said thermal head, and said fixing unit are sequentially disposed in order.

15. The color thermal printer according to claim 3, wherein said paper feed unit, said transport roller pair, said thermal head, said cutter, and said fixing unit are sequentially disposed in order.

16. The color thermal printer according to claim 3, wherein said paper feed unit, said transport roller pair, said thermal head, said fixing unit, and said cutter are sequentially disposed in order.

17. The color thermal printer according to claim 3, wherein said paper feed unit, said transport roller pair, said cutter, said thermal head, said fixing unit are sequentially disposed in order.

18. The color thermal printer according to claim 3, wherein said paper feed unit, said transport roller pair, said fixing unit, said thermal head, and said cutter are sequentially disposed in order.

19. The color thermal printer according to claim 3, wherein said paper feed unit, said transport roller pair, said fixing unit, said cutter, and said thermal head are sequentially disposed in order.

20. This color thermal printer according to claim 3, wherein said paper feed unit, said transport roller pair, said cutter, said fixing unit, and said thermal head are sequentially disposed in order.

21. The color thermal printer according to claim 3, wherein said paper feed unit, said cutter, said transport roller pair, said fixing unit, and said thermal head are sequentially disposed in order.

22. The color thermal printer according to claim 3, wherein said paper feed unit, said cutter, said fixing unit, said transport roller pair, and said thermal head are sequentially disposed in order.

23. The color thermal printer according to claim 3, wherein said paper feed unit, said fixing unit, said cutter, said transport roller pair, and said thermal head are sequentially disposed in order.

24. The color thermal printer according to claim 3, wherein said paper feed unit, said fixing unit, said transport roller pair, said cutter, and said thermal head are sequentially disposed in order.

25. The color thermal printer according to claim 3, wherein said paper feed unit, said fixing unit, said transport roller pair, said thermal head, and said cutter are sequentially disposed in order.

26. A color thermal printer comprising:

a paper feed unit in which a roll of continuous color thermosensitive recording paper is set;

a first transport roller pair, driven by a motor, for nipping an end of the continuous color thermosensitive recording paper to alternately pull-out and pull-back the continuous color thermosensitive recording paper from said paper feed unit;

a cutter, located downstream from said first transport roller pair, for cutting the continuous color thermosensitive recording paper into a print sheet;

a second transport roller pair, driven by said motor and located downstream from said cutter, for nipping the end of the continuous color thermosensitive recording paper to further transport the continuous color thermosensitive recording paper;

a thermal head, located downstream from said second transport roller pair, for recording color images on the continuous color thermosensitive recording paper during pull-back operations; and a fixing unit, located downstream from said thermal head, for selectively irradiating the continuous color thermosensitive recording paper with ultraviolet radiation to fix the recorded color images.

27. The color thermal printer of claim 26, further comprising a shutter disposed between said fixing unit and the continuous color thermosensitive recording paper, said shutter moving between a light shielding position for covering an ultraviolet exposure area of the color thermal printer to shield light from the continuous color thermosensitive recording paper and an open position retracted from said ultraviolet exposure area.

28. The color thermal printer of claim 26, wherein said fixing unit comprises:

first and second ultraviolet lamps for emitting respective first and second ultraviolet radiation to fix the recorded color images on the continuous thermosensitive recording paper; and a rectangular housing within which said first and second ultraviolet lamps are mounted, said rectangular housing having a first window through which the first ultraviolet radiation is emitted and a second window through which the second ultraviolet radiation is emitted, said first and second windows being respectively on first and second opposite ends of said rectangular housing, said rectangular housing being rotatable about a shaft to selectively position said first and second windows adjacent the continuous color thermosensitive recording paper.

* * * * *